United States Patent [19]

Pun

[11] 4,302,903

[45] Dec. 1, 1981

[54] STEPPING DEVICE

[75] Inventor: Kwok-Wah Pun, Kowloon, Hong Kong

[73] Assignee: Kusan, Inc., Brentwood, Tenn.

[21] Appl. No.: 129,178

[22] Filed: Mar. 10, 1980

[51] Int. Cl.[3] ..... A63H 11/00; F03G 3/06

[52] U.S. Cl. ..... 46/150; 46/266; 185/7; 185/33

[58] Field of Search ..... 46/150, 266, 265; 185/2, 6, 7, 32, 33

[56] References Cited

U.S. PATENT DOCUMENTS

| | | | |
|---|---|---|---|
| 827,218 | 7/1906 | De Vos | 185/33 X |
| 1,986,446 | 1/1935 | 01001935 | Powleson/46 |
| 2,660,655 | 11/1953 | Powell | 46/150 X |
| 3,421,258 | 1/1969 | Gardel et al. | 46/150 X |
| 3,678,617 | 7/1972 | Nomura | 46/266 X |

FOREIGN PATENT DOCUMENTS

| | | | |
|---|---|---|---|
| 265343 | 6/1929 | Italy | 185/6 |

*Primary Examiner*—F. Barry Shay

*Attorney, Agent, or Firm*—Dorsey, Windhorst, Hannaford, Whitney & Halladay

[57] ABSTRACT

A stepping device supported on two legs capable of walking or stepping up and down steps. The device has a pair of legs rotatably mounted to and suspended vertically from spaced points on a link. A pendulum is rotatably mounted to the link and suspended vertically from a central axis on the link between the leg mounting points. Means is provided for swinging the pendulum from the vertical thereby increasing the lever arm from the center of gravity of the pendulum to the mounting point of the leg closest to the pendulum. As the pendulum approaches the horizontal, the moment about the mounting point in a direction opposite the direction of pendulum movement exceeds the counter moment about the mounting point. This causes the link to lift the trailing leg up and over the leading leg, thereby maintaining the balance of the device on the supporting leg and causing a stepping movement. Unlike other walking devices, the linkage of the present invention is capable of walking or stepping up and down steps or an inclined plane, as well as traversing a horizontal plane surface.

6 Claims, 16 Drawing Figures

Fig. 8
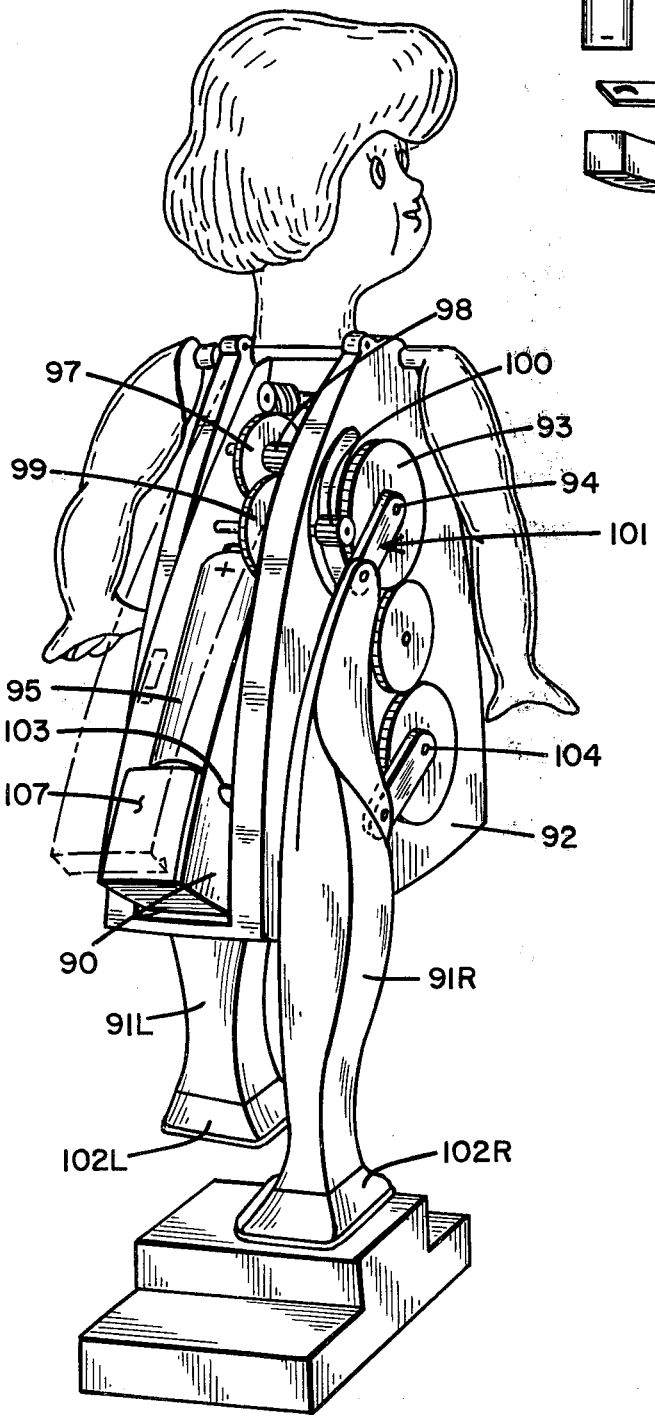
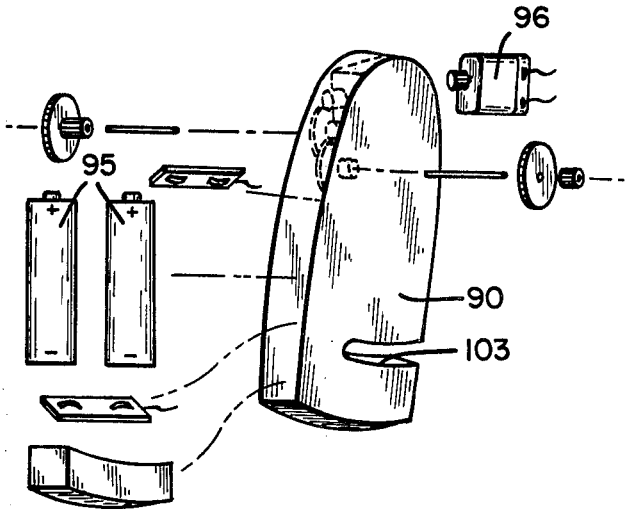
Fig. 10
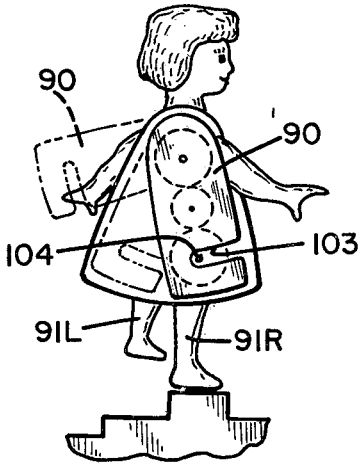
Fig. 11

STEPPING DEVICE

SUMMARY OF THE INVENTION

The stepping device of the present invention is a fundamental linkage that is self-supporting and capable of stepping up and down steps as well as up and down an inclined plane and along a horizontal plane surface. It includes a link in the form of a circular plane gear rotatable about a central horizontal axis. Supporting legs, spaced in the direction of the central axis, are rotatably mounted to and suspended from the link for rotation relative to the link about respective diametrically opposed axes, spaced from and parallel to the central axis. The pendulum is rotatably mounted to and suspended from the link for rotation or swinging movement relative to the link about the central axis. Means is provided for rotating or swinging the pendulum relative to the link, thereby moving the legs in a stepping motion. Each of the legs is provided with a shoe or base that extends laterally on either side of a plane through the center of gravity of the device and perpendicular to the central horizontal axis.

More particularly, two equal-length vertical suspended or hanging legs (representing two legs or arms) with a shoe or base attached to each lower end are provided. The upper end of each leg is rotatably mounted at diametrically-opposed, spaced points on the perimeter of a circular plane gear or link at equal distances from its center. A pendulum, i.e. a lever with a heavy mass attached to its lower end, is pivotally mounted at the center of the circular plane gear or link for lowering and adjusting the center of gravity of the whole system. A battery-powered or wind-up motor is mounted on the pendulum. The motor is geared into slow turning motion to drive a small pinion gear meshed with the teeth of the circular plane gear. Upon rotation of the pinion, the swinging lever with its heavy mass is driven to swing into a cantilevered position so that the moment about the pivot point, or the action of the lever due to gravity, is sufficient to rotate the circular plane gear or link about the point of pivotal mounting between the circular plane gear and the forward support-surface engaging leg, bringing the rear leg forward and above the support surface while the front leg stands firmly on the support surface. The pendulum is always counterbalanced by the moment arm and mass of the circular plane gear and the trailing or rear leg. Thus the center of gravity of the device is always directly below the mounting point between the supporting leg and the circular plane gear. The weight acts downwardly through the forward leg through the center of its base or shoe.

DESCRIPTION OF THE DRAWINGS

FIG. 1A is a side view of the stepping device when supported or balanced on the leading or forward leg with the trailing leg lifted up from the lower step.

FIG. 1B is a similar, but advanced, side view of the device with the trailing leg of FIG. 1A lifted over the supporting leg of FIG. 1A, to thereby become the leading leg in FIG. 1B.

FIG. 1C is a top view of the shoe or base of each leg of FIG. 1B.

FIG. 1D is another side view with the device advanced with respect to FIG. 1B.

In FIG. 1D the device is balanced on the trailing leg and the leading leg is about to come to rest on a lower step.

FIG. 1E is a top view of the shoe or base of each leg of FIG. 1D.

In FIG. 2 the right arm of the doll serves as the pendulum or swinging mass.

FIG. 4 includes a schematic view in which the pendulum takes the form of an axe carried in the right hand of the doll.

FIG. 8 is a perspective view of another embodiment of the present invention in which the pendulum or swinging mass is located within the torso or body of the human figure.

FIG. 10 is an exploded perspective view of the pendulum or swinging mass of FIG. 8.

FIG. 11 is a schematic side view of the human figure of FIG. 8 with the figure supported or balanced on the leading leg with the pendulum or swinging mass swung or rotated forwardly.

BACKGROUND AND DETAILED DESCRIPTION

Stepping toys presently on the market usually employ a set of small wheels sliding along the floor, or forward and rear vibration of a stepping doll's leg involving small level displacements only. In some toys the legs lift to walk, but a fork-like side support must be fitted to the sides of the shoes to prevent falling and the foot steps are so limited that the toy cannot step up and down staircases. Examples of such toys are disclosed in the following U.S. patents: Powleson (U.S. Pat. No. 1,986,446), Gardel et. al. (U.S. Pat. No. 3,421,258) and Nomura (U.S. Pat. No. 3,678,617). An example of a prior art walking device in a field other than toys is provided by the U.S. patent to Powell (U.S. Pat. No. 2,660,655), a walking welding device.

The purpose of this stepping device is to provide a mechanism for supporting on only two legs, or other support members, human-like stepping bodies and other devices, wherein one leg can be lifted as high as the length of its shoe or base while the other leg supports the device without falling. The device is capable of stepping up and down steps or staircases of a uniform step height of about half the length of the shoe or base. As the device moves or steps, its center of gravity is controlled to prevent falling by means of an automatic counterbalancing mass or pendulum. When the pendulum is swung behind the rear leg, the device is supported by the rear or trailing leg, maintaining the center of gravity directly above the supporting shoe area or base. When the pendulum is swung forward of the front leg the device is supported by the front or leading leg.

In one embodiment (FIGS. 5 and 8–11) the pendulum is disposed inside the body of the stepping toy. In another embodiment (FIGS. 2–4) the pendulum is the swinging arm with an object in the hands of the toy such as a girl holding a handbag or a soldier holding a weapon. In still another embodiment, in the case of a stepping toy in which the body is upside down and walks on its hands (FIGS. 6 and 7), the pendulum is the swinging head.

The invention may be used in a large variety of stepping toy designs, including giant creatures imitating walking human beings and other devices.

Figure 1:
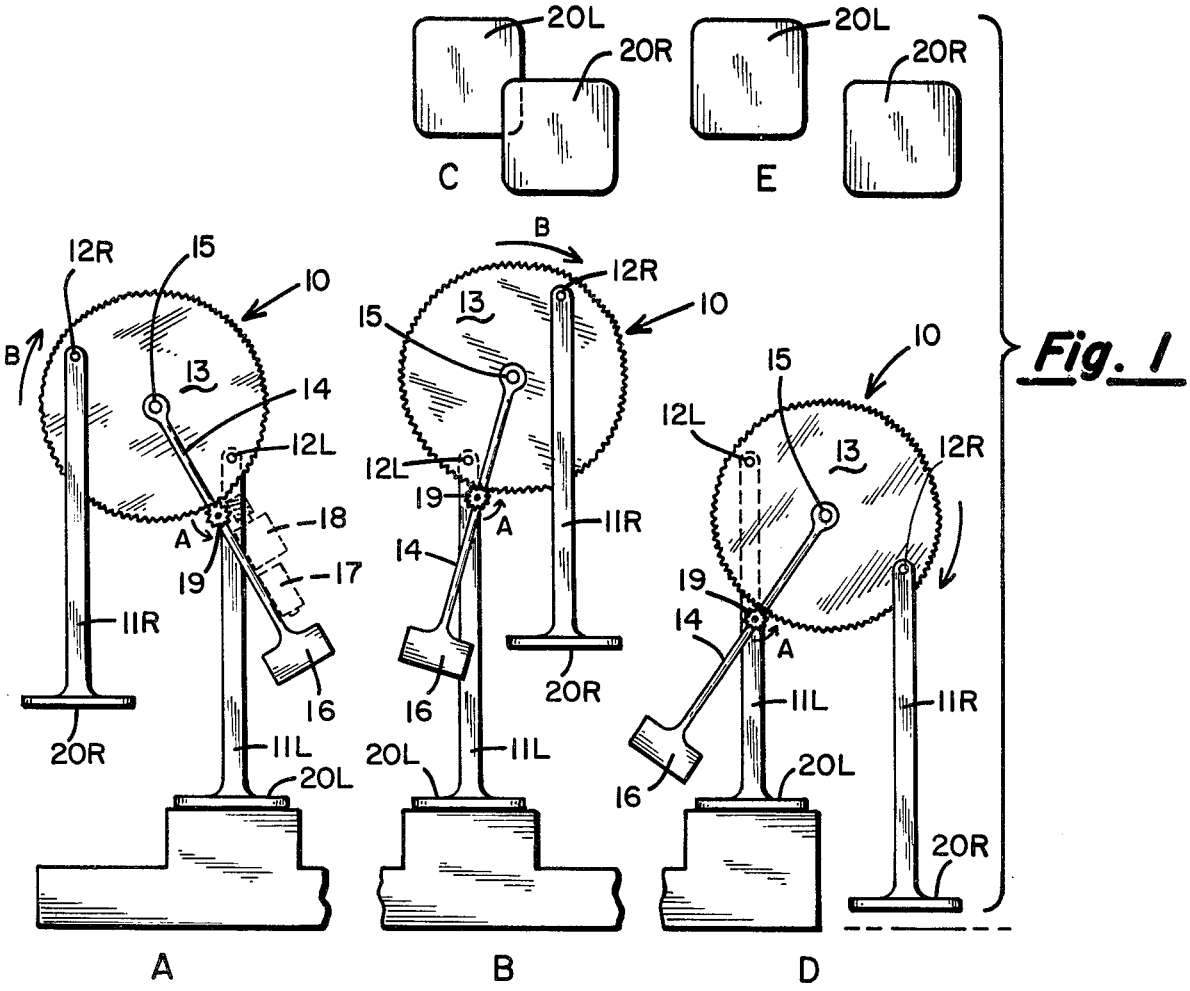
FIG. 1 is a somewhat schematic view of the present invention in three positions.
Figure 9:
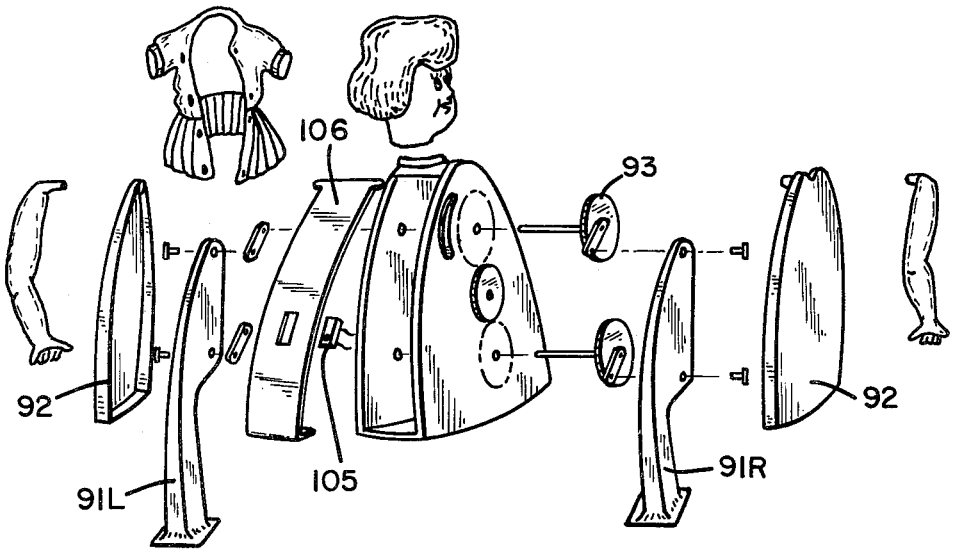
FIG. 9 is an exploded perspective view of the human figure of FIG. 8, with the pendulum or swinging mass ommitted.

The basic structure and operation of the device 10 is shown in FIG. 1. Right and left legs 11R and 11L are suspended at pivot points 12R and 12L, respectively, maintained in parallel relationship by gravity. If desired to make sure they are firmly parallel, two auxiliary gears, above or below the main circular or link gear 13 may be used as shown in FIGS. 2, 3 and 6–8. A swinging lever or pendulum 14 is suspended at pivot point 15 of the main circular gear or link 13 and carries a heavy mass 16 at its lower tip to form a lower center of gravity. The middle of the lever carries a battery 17 which powers a motor 18 for driving a small pinion 19 in the direction shown by arrow, A, to cause pendulum 14 to rotate or pivot counterclockwise with respect to link 13. With reference to FIG. 1A, when pendulum 14 is sufficiently swung or pivoted about point 15 and toward the foremost leg 11L, it becomes extended to a position where it produces a clockwise moment about point 12L that is greater than the counter moment thereabout. As a result main circular gear or link 13 is caused to pivot clockwise in the direction of arrow, B, about point 12L to bring the rear or trailing leg 11R upwardly and forwardly, thereby maintaining the final or resultant center of gravity of the device acting through point 12L within the shoe or base area 20L.

FIG. 1B shows how the rear or trailing leg 11R of FIG. 1A is brought upwardly and forwardly. Continued driving of pinion gear 19 causes circular gear or link 13 to pivot clockwise about point 12L to maintain the combined or resultant center of gravity of the device through hinge point 12L. FIG. 1C is a top view of the base or shoes 20L and 20R of each of the supporting legs 11L and 11R, respectively, and shows the lateral overlapping by about $\frac{1}{3}$ of the combined shoe width so that the resultant center of gravity of the device always acts within the supporting shoe or base to form a stable angle for lateral stability. FIG. 1D shows the stepping device in a more advanced position with its center of gravity still directly below hinge point 12L. In FIG. 1D, leg 11R is about to come to rest, resulting in the device being supported on both legs 11R and 11L. With both legs supporting the device, continued driving of pinion 19 causes pendulum 14 to swing toward the foremost leg (with no pivoting of link 13) until pendulum 14 reaches its extreme forward position as shown in FIG. 1A. Again, the moment of pendulum 14 about the pivot of the foremost leg comes to exceed the countermoment thereabout which causes the stepping motion to repeat. FIG. 1E is a top view of the base or shoes 20L and 20R separated by about $\frac{1}{8}$ of the combined base or shoe length, to enable the device to step up a height of about 50% of the shoe length.

Figure 2:
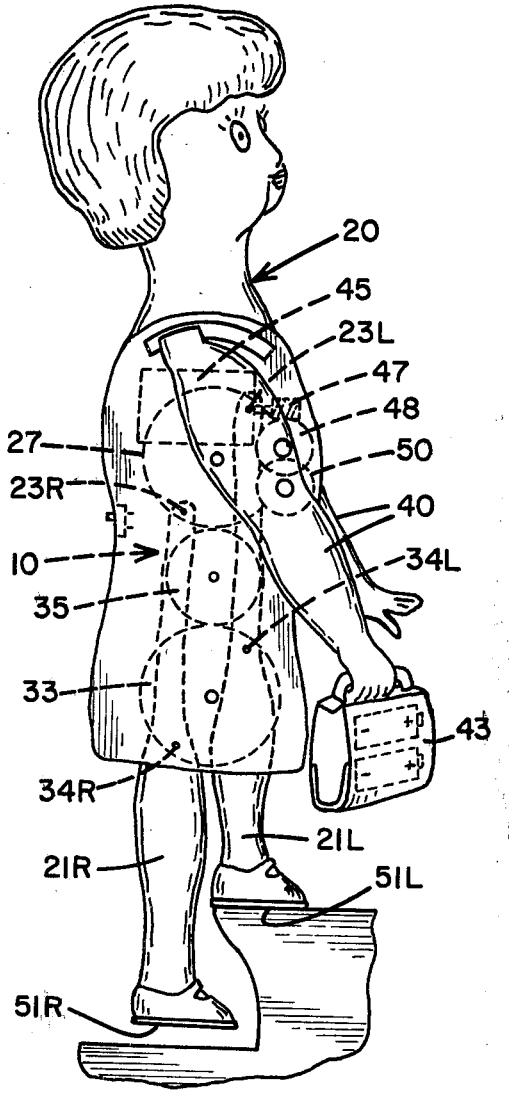
FIG. 2 is a side view of a human figure or doll in which the invention is embodied.
Figure 3:
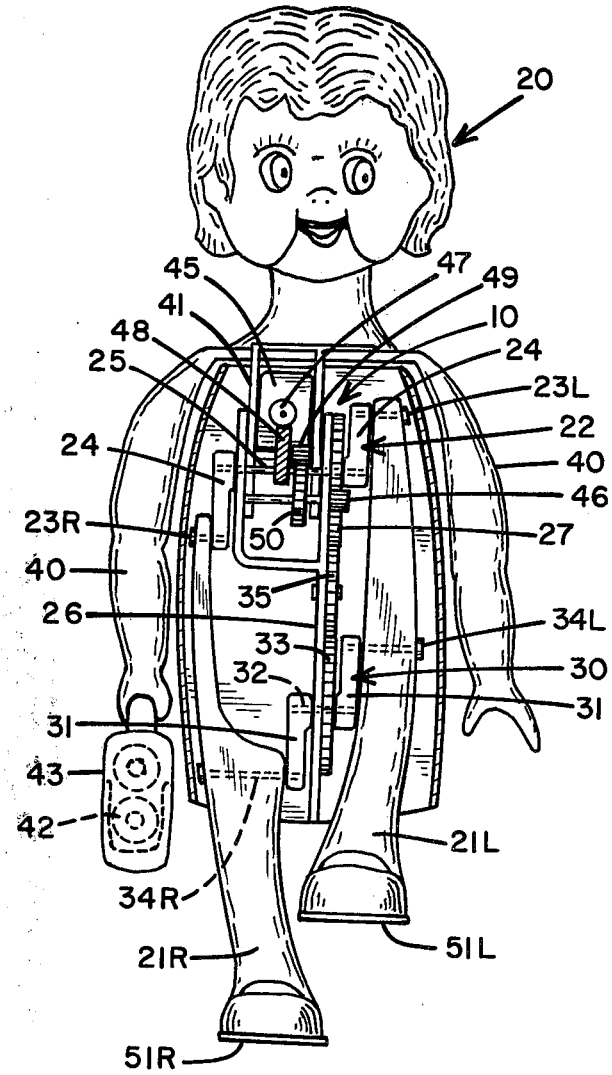
FIG. 3 is a front view of the doll of FIG. 2.
Figure 4:
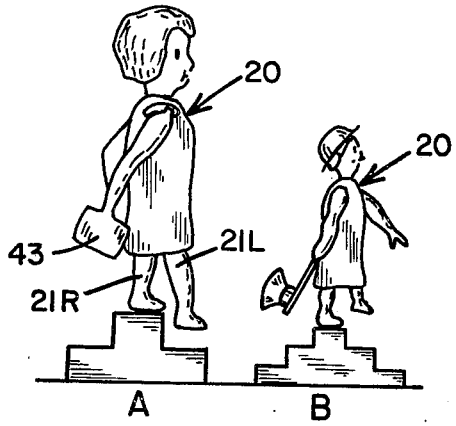
FIG. 4 is a schematic side view of the doll of FIG. 2 balanced on the trailing leg with the pendulum or swinging mass swung or rotated rearwardly.

The stepping device of FIG. 1 may be used in association with a toy figure as shown in FIGS. 2–11. With reference to FIGS. 2–4, the device 10 is mounted in doll 20. Stepping device 10 includes legs 21R and 21L which are rotatably mounted to link assembly 22 at pivot points 23R and 23L, respectively. Link assembly 22 is comprised of arms 24 which are diametrically opposed and fixed to central axis or pin 25, which is rotatably mounted in frame 26. Gear 27 is fixed to pin 25.

Means is provided for positively maintaining legs 21R and 21L in parallel relationship in the form of auxiliary link assembly 30, which includes diametrically opposed arms 31 fixed to pin 32. Gear 33 is fixed to pin 32 and the entire link assembly 30 is rotatably mounted to frame 26. Legs 21R and 21L are rotatably mounted to auxiliary link assembly 30 at points 34R and 34L, respectively. Intermediate gear 35 is rotatably mounted to frame 26 and meshes with gears 27 and 33 to maintain the latter in synchronous relationship with legs 21R and 21L in parallel relationship.

In the embodiment of FIGS. 2–4, the pendulum, equivalent to lever arm 14 and mass 16 of FIG. 1, takes the form of arms 40 which are mounted to bracket 41, which is pivotally mounted to frame 26 at central axis or pin 25. A weight or mass in the form of batteries 42 in handbag 43 is provided in the hand of the right arm 40.

Means is provided in the embodiment of FIGS. 2–4 for rotating the pendulum, arms 40, with respect to link assembly 22 to thereby cause stepping motion, in the form of motor 45, mounted on bracket 41, which drives pinion gear 46 through drive gear 47 and reducing gears 48, 49 and 50 in a traditional manner. Pinion 46 drives gear 27 causing link assembly 22 to rotate about pin 25 and causing legs 21R and 21L to step as they rotate with respect to link assembly 22 at points 23R and 23L, respectively. Legs 21R and 21L are held in parallel relationship throughout the stepping motion by intermediate gear 35 which meshes with both gear 27 and gear 33.

Figure 5:
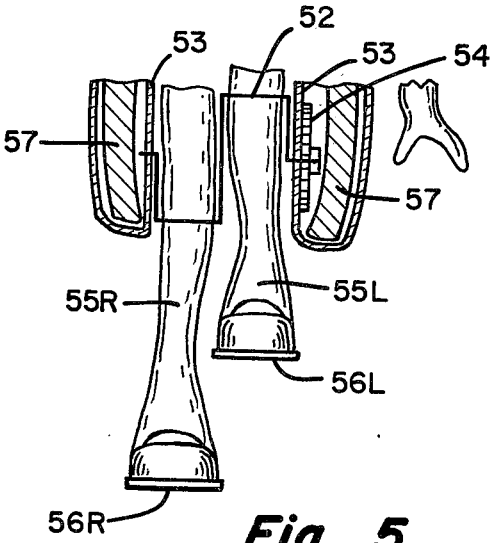
FIG. 5 is a front view of a portion of a figure or doll showing the pendulum or swinging mass disposed in the lower skirt of the figure.

Another embodiment of the invention is shown partially in FIG. 5. FIG. 5 illustrates a variation in the form of an auxiliary crank shaft or link in the form of wire 52, which is rotatably mounted to the body 53 of the figure and fixed to gear 54. Legs 55R and 55L are rotatably mounted to wire 52. This arrangement saves space between the two legs so they can be more closely spaced to provide for lateral overlapping of the shoes or bases 56R and 56L without bending the legs as shown in FIGS. 3. Also, in the embodiment of FIG. 5 the swinging mass 57 is located in the body 53 of the figure so that the arms are free to move as desired for more natural movement.

Figure 6:
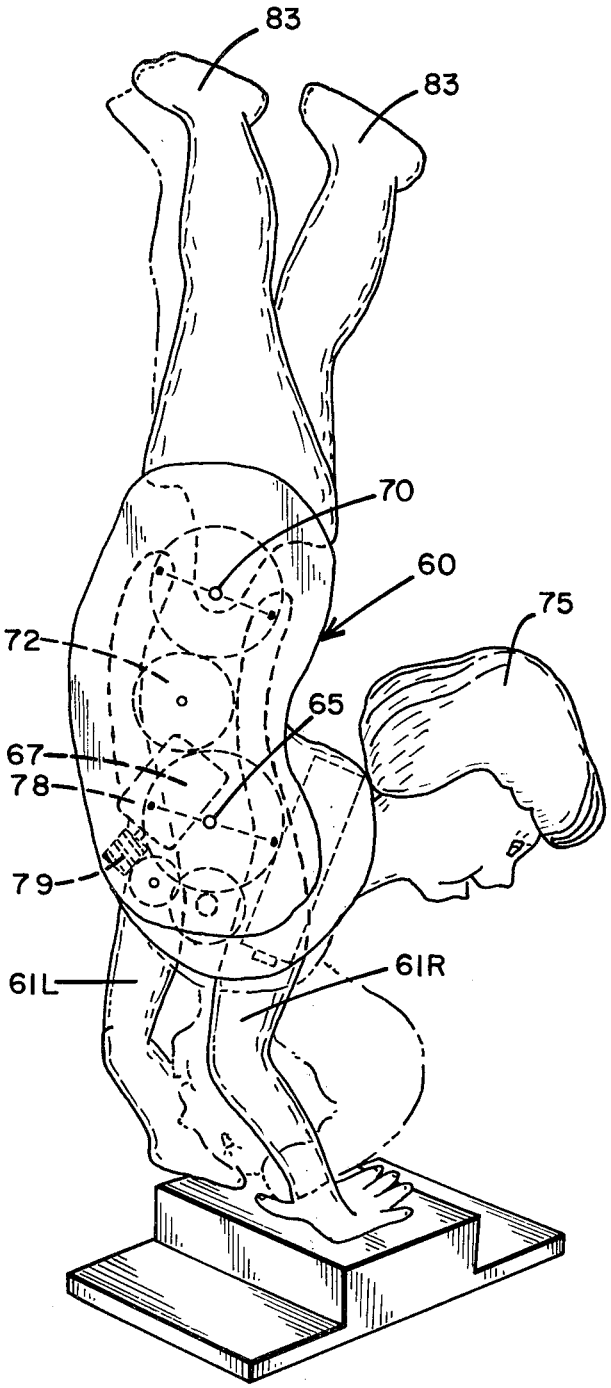
FIG. 6 is a side view of an embodiment of the invention in which the supporting legs are the arms of a human figure and the head of the figure serves as the pendulum or swinging mass.
Figure 7:
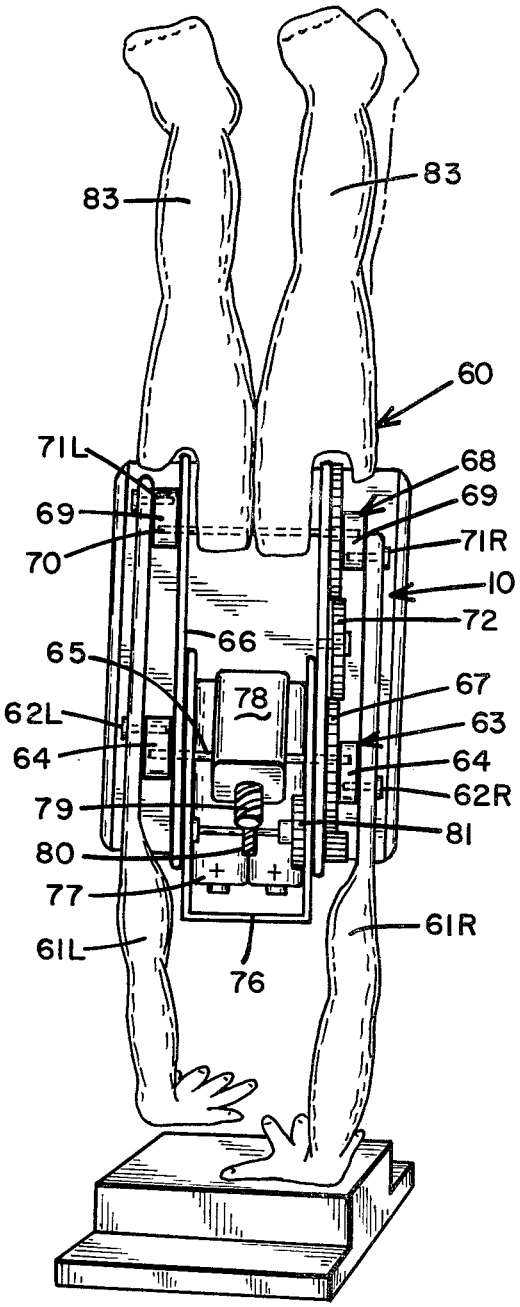
FIG. 7 is a rear view of the human figure of FIG. 6.

Another embodiment of the invention is shown in FIGS. 6 and 7. In this embodiment the toy figure walks on its hands. The arms of the figure serve as the legs of the stepping device and the head serves as the pendulum. The stepping device 10 is mounted in doll 60. Arms 61R and 61L serve as the legs or support members. Arms 61R and 61L are rotatably mounted at pivot points 62R and 62L, respectively, to link assembly 63, which is comprised of link arms 64 which are diametrically opposed and fixed to central axis or pin 65, which is rotatably mounted in frame 66. Main circular gear 67 is fixed with respect to axis 65 and link arms 64.

Means is provided to maintain arms 61R and 61L in parallel relationship in the form of auxiliary link assembly 68, which includes diametrically opposed link arms 69 fixed to axis 70. Axis 70 is rotatably mounted in frame 66. Arms 61L and 61R are rotatably mounted to link arms 69 at points 71L and 71R, respectively. Intermediate gear 72 is rotatably mounted to frame 66 and meshes with circular main gear 67 and auxiliary gear 73, which is fixed to shaft 70, to maintain the arms 61R and 61L in parallel relationship.

The head 75 of the figure of the embodiment of FIGS. 6 and 7 serves as the pendulum of the stepping device, equivalent to the pendulum 14 and weight 16 of FIG. 1. Head 75 is mounted to bracket 76 which is pivotally mounted for pendulous movement about pin 65. Batteries 77 and motor 78 are mounted on bracket 76 to serve, together with head 75, as a pendulum.

Means comparable to that of FIGS. 2–4 is provided for swinging the pendulum, i.e. bracket 76 with head 75 and batteries 77 and motor 78 mounted thereto, with respect to link assembly 63, to cause a stepping action. Thus, motor 78 drives gear 79, which drives reducing gears 80 and 81 and pinion 82, which meshes with main circular gear 67. Bracket 76 is thereby caused to rotate with respect to circular main gear 67, thus causing the head to swing and the arms to step in the manner of the stepping action previously explained in connection with FIG. 1.

It should be noted that legs 83 are pivotally mounted to pin 70 to swing freely as shown in dotted lines to add further interest to the toy figure.

A final embodiment of the invention is shown in FIGS. 8–11, in which the swinging balancing mass or pendulum 90 is disposed between the two legs 91R and 91L in the frame 92 suspended from the main circular plane gear 93 at pin 94 through a rectangular frame 92. Two batteries 95 and a motor 96 are mounted on the swinging balancing mass 90. Motor 96 acts through reducing gears 97, 98 and 99 to drive pinion gear 100, which in turn drives main circular gear 93. Circular main gear 93 drives legs 91R and 91L through link assembly 101, in the manner previously described. Legs 91R and 91L are supported on shoes 102R and 102L with the resultant center of gravity passing through the shoe base, thereby preventing forward and backward falling as well as lateral falling. A pair of swinging arms are hinged at the shoulder. Wire connectors (not shown) connect the legs with the arms so that when the right leg 91R moves rearwardly the left arm moves forwardly and, similarly, when the left leg 91L moves rearwardly, the right arm moves forwardly in a natural way corresponding to actual human walking movement. The swinging mass or pendulum has a cavity or indentation 103 to accommodate shaft 104 when the mass swings forwardly. Switch 105 is mounted on the back cover 106 which can be opened to replace the battery. An additional weight 107 is provided to add weight to pendulum 90 and lower its center of gravity.

The operation of the embodiment of FIGS. 8–11 is shown in FIG. 11, which shows the swinging movement of pendulum 90 and how it counterbalances the rear leg 91L when the other leg 91R moves forwardly to become the supporting leg. For replacing the battery, the swinging mass 90 can be moved into the position shown in dotted lines.

While the foregoing description is primarily with reference to use of the linkage of the invention in a doll or toy human figure, the linkage can be used in other applications in which a self-supporting, stepping mechanism is desired. Such applications may include a remote controlled robot device for use in contaminated (such as radioactive) environments, automatically stepping and advancing welding machines and other applications that require a self-supporting, stepping capability.

I claim:

1. A stepping device which comprises:

a. a link;

b. first and second legs rotatably mounted to said link for rotation relative to said link about respective first and second spaced horizontal axes, said legs being spaced in the direction of said axes;

c. a base on each of said legs, each of said bases extending laterally on either side of a plane perpendicular to said axes through the center of gravity of the device;

d. a pendulum mounted to said link for rotation about a third horizontal axis disposed between and parallel to said first and second axes;

e. said pendulum, link and legs being constructed and arranged with respect to each other so that, when said device is supported in an upright position on said bases, the pendulum can be positioned such that the moment of said pendulum about the foremost of said first and second axes comes to exceed the counter moment thereabout, as said pendulum swings forwardly of said device, and f. means for swinging said pendulum relative to said link forwardly about said third axis, to thereby move said legs in a stepping motion.

2. The stepping device of claim 1 and means for maintaining said legs in parallel relationship.

3. The stepping device of claim 1 wherein said link is a circular disc and said pendulum is rotatably mounted to the center of said disc.

4. The stepping device of claim 3 wherein said means for swinging said pendulum relative to said link comprises a pinion gear rotatably mounted to said pendulum, engaging the periphery of said link, and means for driving said pinion gear.

5. The stepping device of claim 3 and means for maintaining said legs in parallel relationship.

6. The stepping device of claim 4 and means for maintaining said legs in parallel relationship.

* * * * *